US007600559B2

(12) United States Patent
Strähle et al.

(10) Patent No.: US 7,600,559 B2
(45) Date of Patent: Oct. 13, 2009

(54) PLATE HEAT EXCHANGER

(75) Inventors: Roland Strähle, Unterensingen (DE); Daniel Borst, Nürtingen (DE); Frank Vetter, Neuhausen (DE); Herbert Marschner, Göppingen (DE); Daniel Welchner, Zell u.A. (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 11/072,130

(22) Filed: Mar. 4, 2005

(65) Prior Publication Data

US 2005/0194123 A1 Sep. 8, 2005

(30) Foreign Application Priority Data

Mar. 5, 2004 (DE) ..... 10 2004 010 640

(51) Int. Cl.
*F28F 3/08* (2006.01)
*F28F 1/02* (2006.01)

(52) U.S. Cl. ..... 165/167; 165/170

(58) Field of Classification Search ..... 165/167, 165/168, 169, 170, 153, 166
See application file for complete search history.

(56) References Cited

U.S. PATENT DOCUMENTS

| | | | | | |
|---|---|---|---|---|---|
| 2,528,013 | A * | 10/1950 | Morris | 165/167 |
| 2,616,671 | A * | 11/1952 | Wakeman | 165/167 |
| 2,733,244 | A * | 1/1956 | Sanberger et al. | 544/242 |
| 4,987,955 | A * | 1/1991 | Bergqvist et al. | 165/167 |
| 5,462,113 | A * | 10/1995 | Wand | 165/167 |
| 5,544,703 | A * | 8/1996 | Joel et al. | 165/167 |
| 6,354,002 | B1 * | 3/2002 | Wright et al. | 29/890.03 |
| 6,530,425 | B2 * | 3/2003 | Wehrmann et al. | 165/167 |
| 6,843,311 | B2 * | 1/2005 | Evans et al. | 165/167 |
| 6,918,434 | B2 | 7/2005 | Strähle | |
| 6,953,081 | B2 * | 10/2005 | Klingler et al. | 165/43 |
| 2004/0026071 | A1 | 2/2004 | Hesse et al. | |
| 2005/0155749 | A1 * | 7/2005 | Memory et al. | 165/167 |

FOREIGN PATENT DOCUMENTS

| | | | |
|---|---|---|---|
| DE | 3215961 | A * | 11/1983 |
| EP | 1 400 772 | A2 | 7/2003 |
| FR | 2679021 | A1 * | 1/1993 |
| GB | 2249621 | A * | 5/1992 |
| WO | WO 01/69157 | A2 | 9/2001 |
| WO | WO 03/054468 | A1 | 7/2003 |

* cited by examiner

*Primary Examiner*—Tho V Duong
(74) *Attorney, Agent, or Firm*—Michael Best & Friedrich

(57) ABSTRACT

A plate heat exchanger for exchanging heat between first and second media, including a plurality of first heat exchanger plates alternately stacked with a plurality of second heat exchanger plates between a base plate and a cover plate. The first and second heat exchanger plates have at least four passages therethrough which align to define a first collecting channel and a first distribution channel for the first media and a second collecting channel and a second distribution channel for the second media. First flow channels for the first media each are defined in a space between one side of the first heat exchanger plate and a facing one side of the adjacent second heat exchanger plate. Second flow channels for the second media each are defined between the other side of the first heat exchanger plate and the other side of the adjacent second heat exchanger plate. The second flow channels are defined by recesses defined in the surface of the other side of at least one of the first and second heat exchanger plates, and the other sides are metallically connected along their surfaces.

16 Claims, 6 Drawing Sheets

PLATE HEAT EXCHANGER

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to a heat exchanger, and more particularly to a plate heat exchanger in which two different media alternately flow in heat exchange fashion in spaces between stacked plates of the heat exchanger.

BACKGROUND OF THE INVENTION AND TECHNICAL PROBLEMS POSED BY THE PRIOR ART

Plate heat exchangers of a type generally corresponding to those corresponding to the present invention are shown in EP 14 00 772 A2 (assigned to the assignee of this application, published Mar. 24, 2004) and corresponding U.S. Publication No. 2004/112579 A1 (also assigned to the assignee of this application, and published Jun. 17, 2004), the full disclosures of which are hereby incorporated by reference. The plate heat exchanger disclosed therein is suitable for heat exchange between media under a relatively high pressure, as prevails, for example, in an air conditioning loop on the refrigerant side. However, while those publications disclose an advantageous pressure-stable design of the collecting and distribution channels (i.e., the output and input) for the refrigerant (e.g., $CO_2$) passing through the stacked plates, they disclose flow channels between the plates for $CO_2$ gas which the present invention may advantageously improve upon.

WO 03/054468 A1 discloses a device for exchanging heat which is also a component of an air conditioning loop. In this device, all of the heat exchanger plates are difficult to manufacture, and the device may be viewed as still taking up more space than desired in many applications in which space limitations are critical. In these respects, the heat exchanger disclosed in WO 01/69157 A2 (corresponding to U.S. Publication No. 2004/26071 A1) appears to be more advantageous for a vehicle air conditioner. However, a so-called intermediate heat exchanger is otherwise disclosed in which refrigerant at a higher temperature is in heat exchange with the same refrigerant at lower temperature. Fine channels are provided there in all the flow channels of the heat exchanger, which channels are produced by manufacturing methods involving addition or removal of material on or in the heat exchanger plates.

The present invention is directed toward overcoming one or more of the problems set forth above.

SUMMARY OF THE INVENTION

According to one aspect of the present invention, a plate heat exchanger is provided for exchanging heat between a first media and a second media, including a plurality of first heat exchanger plates alternately stacked with a plurality of second heat exchanger plates between a base plate and a cover plate. The first and second heat exchanger plates have at least four passages therethrough which align to define a first collecting channel and a first distribution channel for the first media and a second collecting channel and a second distribution channel for the second media. First flow channels for the first media each are defined in a space between one side of the first heat exchanger plate and a facing one side of the adjacent second heat exchanger plate. Second flow channels for the second media each are defined between the other side of the first heat exchanger plate and the other side of the adjacent second heat exchanger plate. The second flow channels are defined by recesses defined in the surface of the other side of at least one of the first and second heat exchanger plates, and the other sides are metallically connected along their surfaces.

In one form of this aspect of the present invention, the recesses are embossments in the at least one of the first and second heat exchanger plates.

In another form of this aspect of the present invention, the recesses are groove-like furrows in the first heat exchanger plates, with the second flow channels being defined by the groove-like furrows and the facing flat surface of the second heat exchanger plates aligned over the furrows.

In still another form of this aspect of the present invention, the second flow channels provide a hydraulic connection between the second collecting channel and the second distribution channel and the recesses are defined in a significant portion of the at least one of the first and second heat exchanger plates, whereby the passages defining the second collecting and distribution channels extend through the significant portion.

In yet another form of this aspect of the present invention, the recesses are groove-like furrows arranged in a mirror symmetry about an axis of the heat exchanger plates whereby second flow channels of generally equal length are present on opposite sides of the axis.

According to another form of this aspect of the present invention, the recesses are defined in the second heat exchanger plates, and the second heat exchanger plates have a significantly greater plate thickness than the first heat exchanger plates. According to an alternate form of this aspect of the present invention, the first and second heat exchanger plates have the same plate thickness.

According to still another form of this aspect of the present invention, the recesses are defined in a significant portion of the at least one of the first and second heat exchanger plates, and the passages defining the first collecting and distribution channels extend through the first and second heat exchanger plates outside of the significant portion. According to a further form, the first heat exchanger plates are metallically joined to the second heat exchanger plates at adjacent surfaces outside of the significant portion.

According to yet another form of this aspect of the present invention, the first and second heat exchanger plates have a continuous bent edge at which adjacent heat exchanger plates are metallically connected to each other. According to a further form, the recesses are defined in the surface of the plurality of the second heat exchanger plates, and the bent edges of the plurality of first heat exchanger plates are longer than the bent edge of the plurality of the second heat exchanger plates.

In another form of this aspect of the present invention, the recesses are defined in a significant portion of the second heat exchanger plates, where the recesses include a plurality of substantially parallel groove-like furrows surrounding an enclosed portion of the significant portion, and the recesses further include additional groove-like furrows in the enclosed portion defining regions between selected groove-like furrows with a flat surface on the other side of the second heat exchanger plates. According to a further form, the groove-like furrows wind around within the enclosed portion, and not all of the groove-like furrows in the enclosed portion are generally parallel.

In still another form of this aspect of the present invention, the first heat exchanger plates include a flat surface and the second heat exchanger plates include flat surfaces between the recesses, and adjacent flat surfaces of the first heat exchanger plates and second heat exchanger plates are metallically joined together. According to a further form, the recesses are defined in a significant portion of the second heat exchanger plates, and the recesses include a plurality of substantially parallel groove-like furrows surrounding an enclosed portion of the significant portion, and additional groove-like furrows in the enclosed portion define regions between selected groove-like furrows with a flat surface on the other side of the second heat exchanger plates. Also according to this further form, the first and second heat exchanger plates are metallically joined at adjacent flat surfaces defined outside of the significant portion, at adjacent flat surfaces in the defined regions, and between the furrows, whereby the second flow channels defined by the furrows are discrete.

In yet another form of this aspect of the present invention, turbulence inserts are in the first flow channels between the spaced one sides of the first and second heat exchanger plates.

In a still further form of this aspect of the present invention, the recesses are defined by embossed sides of one of the plurality of first and second heat exchanger plates, the other side of the other of the plurality of first and second heat exchanger plates is substantially flat, and the first media is engine coolant and the second media is $CO_2$ refrigerant of a vehicle air conditioner. According to a further form, a rod-like element is in the second collecting and distribution channels adapted to increase the pressure stability of the plate heat exchanger.

In a further form of this aspect of the present invention, one of the media is oil and the other of the media is water.

DETAILED DESCRIPTION OF THE INVENTION

Figure 1:
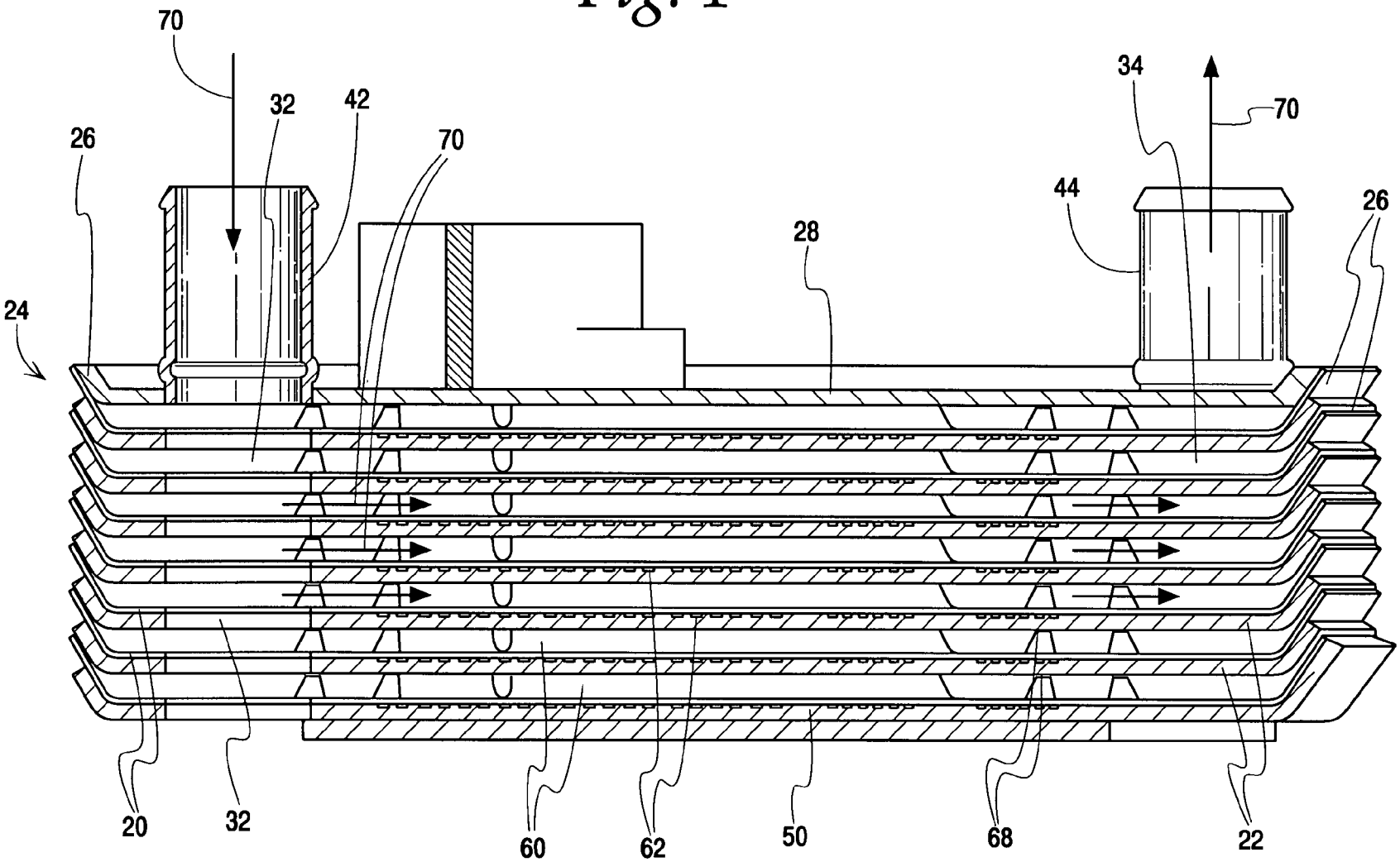
FIG. 1 is a vertical cross-section through the coolant side of a plate heat exchanger according to one embodiment of the present invention.

Plate heat exchangers according to the present invention may be advantageously used, for example, for heat exchange between the refrigerant (e.g., $CO_2$) and the coolant of the a vehicle engine and, in such use, may be integrated in a suitable fashion both in the refrigerant loop of the air conditioner and in the coolant loop.

In the depicted embodiments, the plates 20, 22 of the plate heat exchanger 24 consist of aluminum sheets coated with solder. Though the plates 20, 22 are illustrated as hexagonally shaped as may be advantageously used in the described structure, it should be understood that plates which are not hexagonally shaped may be advantageously used within the scope of the present invention, with the shape chosen according to the intended use. The heat exchanger plates 20 and 22 are produced from aluminum sheets so as to be trough-like with a beveled edge 26 (in the FIG. 1 illustration, the edges 26 of the plates 20, 22 slope upward.).

Each plate 20, 22, as well as the cover plate 28, is provided with four passages or openings 30. These openings 30, when stacked, form collecting and distribution channels (i.e., inlets and outlets) for the media which flows through the heat exchanger for the purpose of exchanging heat. Specifically, distribution channel 32 receives coolant and distributes it through a first plurality of flow channels between the plates (described below), through which the coolant flows to the collecting channel 34. Distribution channel 36 receives refrigerant and distributes it through a second plurality of alternating flow channels between the plates (described below), through which the refrigerant flows to the collecting channel 38. Suitable connectors 42, 44, 46, 48 may be advantageously provided with the heat exchanger 24 to facilitate connection to the system (e.g., vehicle engine and air conditioner) with which it is to be used. The connectors 46, 48 for the refrigerant may advantageously be suitable high-pressure fittings to accommodate the high-pressure of the refrigerant.

In the particular embodiment illustrated in FIG. 1, the base plate 50 is not formed with passages, with the feed and discharge of the $CO_2$ gas and coolant being provided on the cover plate 28. However, it should be appreciated that, depending upon the intended use and arrangement of connections to the system with which it is being used, openings could variously be located on the base plate 50 (with suitable connectors) within the scope of the present invention.

As previously indicated, the heat exchanger plates 20, 22 are assembled into a stack. One plurality of alternating flow channels 60 for the coolant is provided in a space between the plates 20, 22 (in the FIG. 1 orientation, between the top side of thicker plates 22 and the lower side of thin plates 20. Alternating between those flow channels 60 are flow channels 62 for the refrigerant as described in greater detail below.

Fins 68 may be advantageously provided in the coolant flow channels 60 between the spaced sides of the plates 20, 22. Such fins 68 may be configured so as to enhance heat exchange efficiency with the coolant traversing the fins 68 in channels 60, and may also contribute to greater pressure resistance by soldering to the facing sides of the plates 20, 22.

Coolant flow is shown by the arrows 70 in FIG. 1. Coolant flows into the distribution channel 32 of the plate heat exchanger 24 via connector 42 and leaves it again via the collecting channel 34 and the connector 44 after flowing through flow channels 60. Similarly, as illustrated by the dashed arrows 72 in FIG. 3, the refrigerant flows into distribution channel 36 via connector 46 and leaves it again at through collecting channel 38 and connector 48 after flowing through the flow channels 62.

Figure 3:
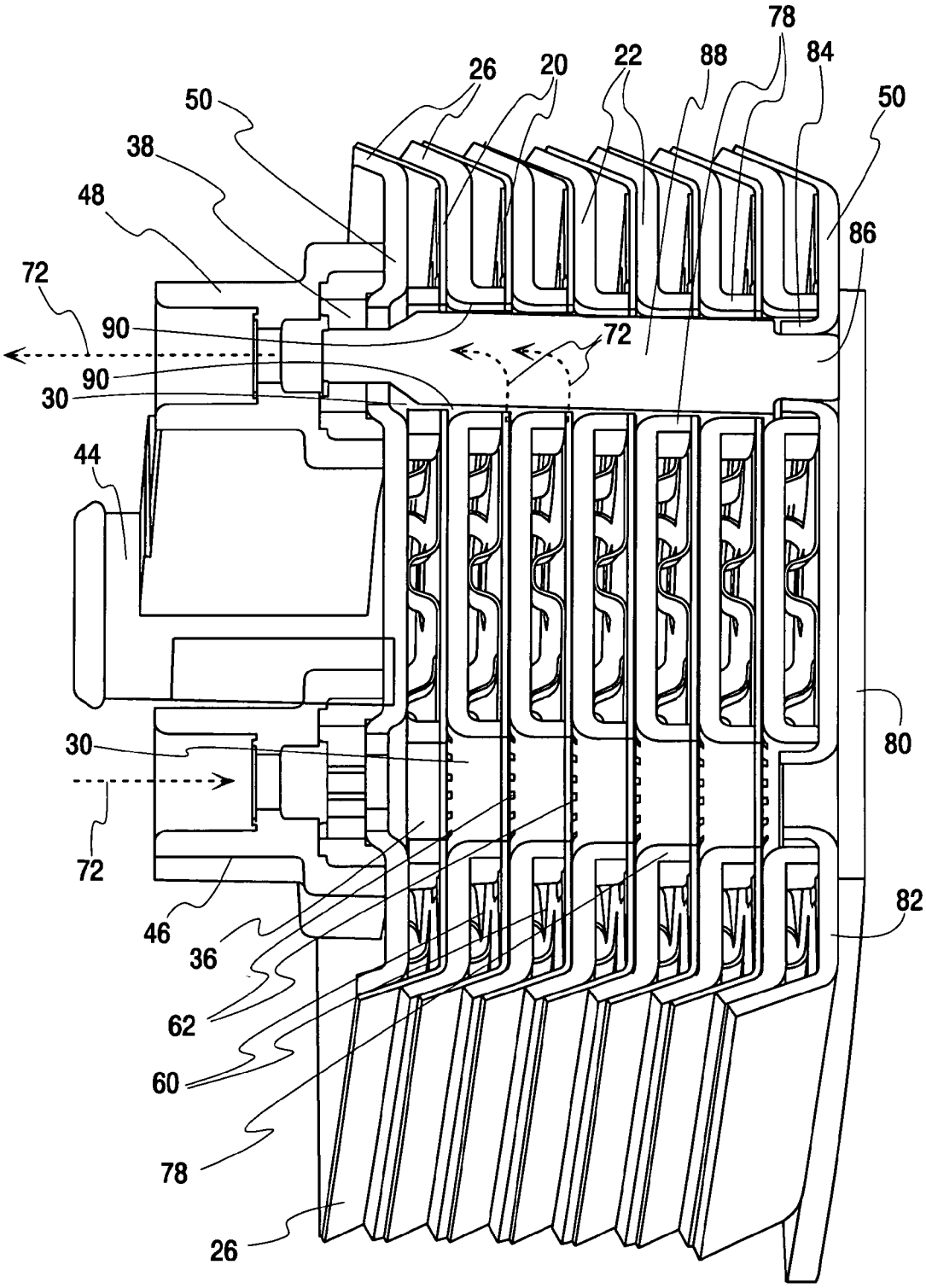
FIG. 3 is a vertical cross-section through the refrigerant side of the plate heat exchanger.

Every other flow channel 62 (i.e., alternating flow channels) in the illustrated practical example is hydraulically connected to the distribution and collecting channels 36, 38. Further, since the flow channels 60, 62 formed by the heat exchanger plates 20, 22 alternate, the first flow channels 60 are hydraulically connected to the other distribution and collecting channels 32, 34. As is illustrated in FIG. 3, the heat exchanger plates 22 may be advantageously formed around the openings 30 to define collars 78 (e.g., integrally produced by deformation of the plates 22) which block hydraulic connection of distribution channel 36 and collecting channel 38 into the flow channel 60. Suitable separate collar rings could alternatively be provided to block refrigerant flow (in channels 36, 38) from coolant flow (in channels 60).

The base plate 50 may consist of a bottom plate 80 over a flange plate 82 with a reducing piece 84 which is soldered in the lower end 86 of a reinforcing element 88 to provide the required pressure stability. The $CO_2$ refrigerant can flow in an annular gap 90 situated between the reinforcing element 88 and the edge of the distribution or collecting channel 36, 38 (note that, in FIG. 3, only one reinforcing element 88 is shown, in collecting channel 38, with the similar reinforcing element 88 in distribution channel 36 omitted to permit clear illustration of other details therein). The upper end of the reinforcing element 88 is also suitably secured to allow for flow between the associated channels and connectors 36, 46 and 38, 48. This connection is fully disclosed in incorporated U.S. Publication No. 2004/112579 A1, which can be referred to for further understanding in this respect. The type of reinforcing element 88 disclosed here is merely exemplary. Moreover, the reinforcing element 88 can be omitted in, for example, lower pressure applications such as oil cooler because the much lower pressures prevailing there permit it.

Referring now to the flow channels 62 for $CO_2$ refrigerant (which is typically at high pressure), in accordance with the present invention, these channels 62 may be advantageously formed by connection of one surface side of an embossed heat exchanger plate 22 with the flat surface side of an unembossed facing heat exchanger plate 20. The other flow channels 60 (for the coolant) are bounded by the other surface side of the embossed heat exchanger plate 22 and the other spaced surface side of the unembossed heat exchanger plate 20.

Figure 2:
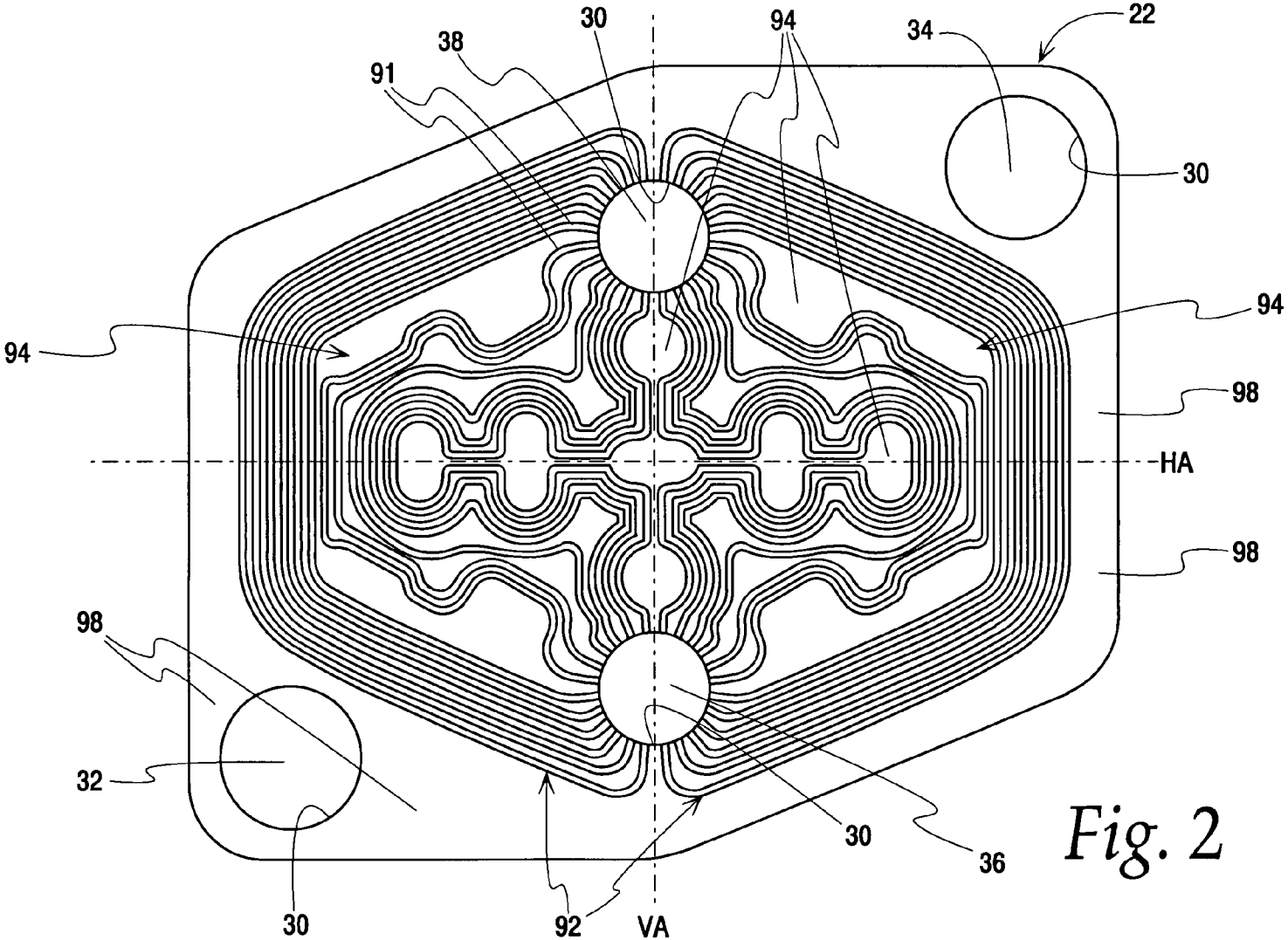
FIG. 2 a plan view of an embossed heat exchanger plate according to one embodiment of the present invention.
Figure 4:
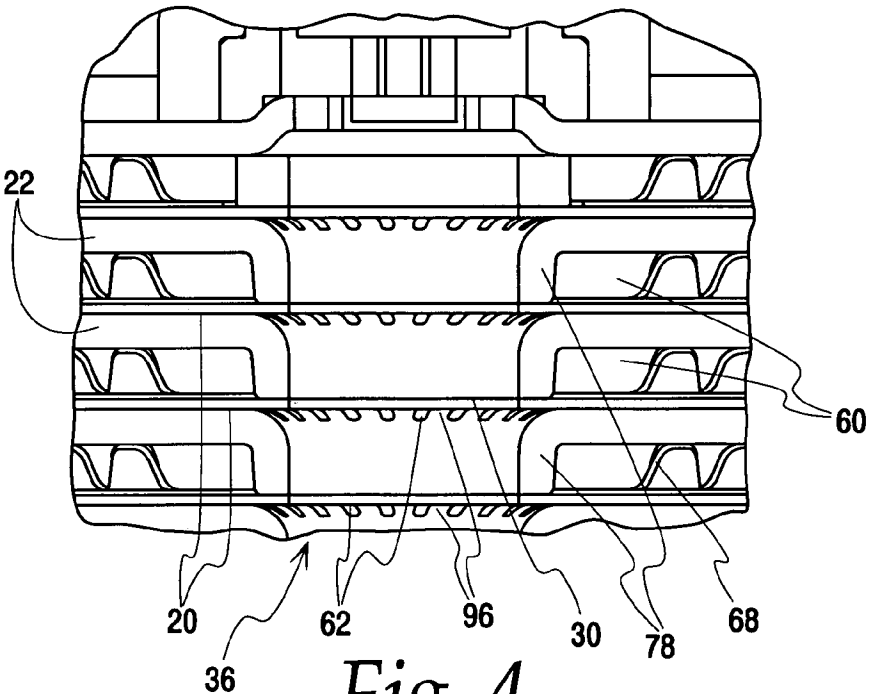
FIG. 4 is an enlarged cross-section of a portion of FIG. 3.

FIG. 2 shows a view of an embossed heat exchanger plate 22, which (in this embodiment) is the thicker of the two heat exchanger plates 20, 22. Embossed structures such as recesses 91 are in the depicted surface side of the embossed heat exchanger plates 22, formed as groove-like furrows 91. The embossings may be advantageously produced by an embossing die on a press, created by cold deformation from a corresponding aluminum sheet, although embossing rolls may be used. This surface side in the practical example depicted in FIG. 1 lies essentially flat against the surface side of an unembossed and essentially also flat heat exchanger plate 20 so that the groove-like furrows 91 form the flow channels 62 for the refrigerant (e.g., $CO_2$). In the orientation of FIGS. 1 and 4, the embossed surface side of the plates 22 faces upward and the other heat exchanger plate 20 lies with its bottom surface flat against it. The ends of the flow channels 62 open to the collecting and distribution channels 36, 38 for refrigerant flow therebetween are readily apparent in FIG. 4.

It should be appreciated that while the embossment illustrated in FIG. 2 may give the impression of an ornamental design, in fact the illustrated design is geared toward achieving advantageous technical effects. That is, the section 92 of the heat exchanger plates 22 covered with the furrow structures 91 may advantageously be as large as possible so that it may be utilized as well as possible for heat exchange. Further, particularly advantageous heat exchange may be achieved where the same pressure loss, to the extent possible, occurs in all of the flow channels 62. Skillful choice of the configuration and length of each flow channel may be used to achieve such equalized pressure loss. Still further, uniform distribution of the flow channels 62 over the entire section 21 is also advantageous and, in accordance with one aspect of the invention, the flow channels 62 may therefore be advantageously configured in section 92 so as to be symmetric both to a vertical axis VA and a horizontal axis HA, as a result of which the length of all flow channels 62 is advantageously roughly the same.

Island-like regions 94 are advantageously provided within the embossment design within the section 92. As a result, a strong metallic connection (e.g., soldering) may be achieved between adjacent plate surfaces in those regions which is able to support the extremely high pressures of up to 300 bar which may occur. Such strength may also be achieved with the heat exchanger plates 20 being much thinner than the other heat exchanger plate 22. (A metallic connection with the thinner heat exchanger plate 20 is naturally also present on the walls 96 (see FIG. 4) between the groove-like furrows 91, but such connection alone, as the inventor has discovered, may not furnish sufficient strength because of the relatively small surface fraction.

It should also be appreciated that advantageous manufacturing may further be achieved inasmuch as so-called strippers are formed in the embossing die (not shown) at least in some of these island-like regions 94, which ensure that the heat exchanger plate 22 can be readily removed from the die after an embossing process.

Areas 98 lying outside of the embossed section 92 are also connected flat to the other heat exchanger plate 20 over a broad expanse of surface to further assist in securing the plates 20, 22 together as desired. Moreover, it should be recognized that an excellent metallic connection between the walls 96 (FIG. 4) between flow channels 62 and the adjacent heat exchanger plate 20 may be particularly advantageous in providing the flow channels 62 which are discrete without flow between individual channels 62 (i.e., the parallel flow channels 62 preferably are not in a short-circuit-like hydraulic connection with each other).

As previously noted, the hexagonal shape of the illustrated heat exchanger plates 20, 22 are merely exemplary to one possible application. However, it should be appreciated that this shape may advantageously provide the additional area 98 for securing the plates 20, 22 together, and may also advantageously allow for the design in which the collecting and distribution channels 32, 34 for the coolant lie outside of section 92 whereas the collecting and distribution channels 36, 38 for the refrigerant (e.g., $CO_2$) are arranged within the section 92.

It should also be recognized (see particularly FIGS. 1 and 3) that the edges 26 of the thicker heat exchanger plates 22 are significantly shorter than the edges 24 on the thinner heat exchanger plates 20. This may be done because, on the one hand, pressures that permit this design prevail on the coolant side and, on the other hand, the $CO_2$ gas under high pressure flows on the side on which a durable flat metallic joint is present between the thin heat exchanger plate 20 and the thicker heat exchanger plate 22 as previously described. This leads to an extremely compact configuration of the plate heat exchanger and also leads to significant material and weight savings due to the number of such plates 20, 22 in each heat exchanger 24.

Figure 5:
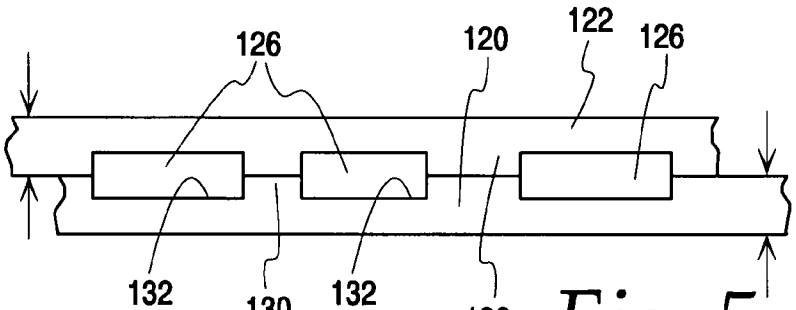
FIG. 5 is a cross-sectional view illustrating flow channels according to a second embodiment of the present invention.
Figure 6:
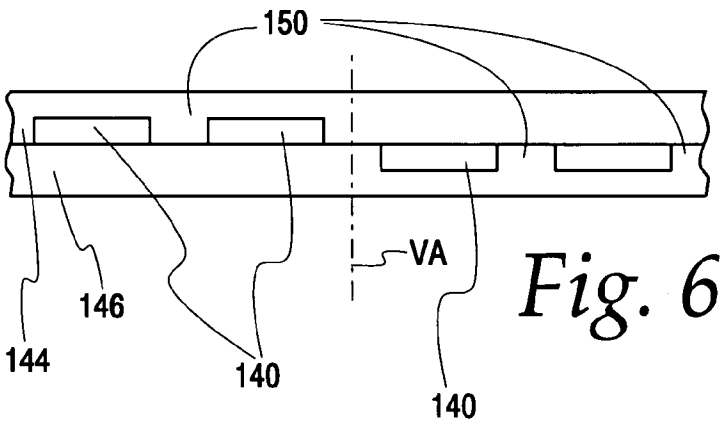
FIG. 6 is a cross-sectional view illustrating flow channels according to a third embodiment of the present invention.

FIGS. 5 and 6 illustrate still other configurations for forming the flow channels 62 in accordance with at least some aspects of the present invention. That is, in the embodiment shown in FIG. 5, both heat exchanger plates 120, 122 include matching recesses which are joined together to form flow channels 126, with the walls 130 between the furrows 132 of one plate 120 and the walls 136 of the other plate 122 metallically connected. Other modifications (not shown) of such practical examples can be made. As illustrated in FIG. 6, the flow channels 140 may also be formed by furrows in one or the other plate 144, 146, with the walls 150 between those furrows metallically connected to flat surfaces of the opposite plate 146, 144.

Figure 7:
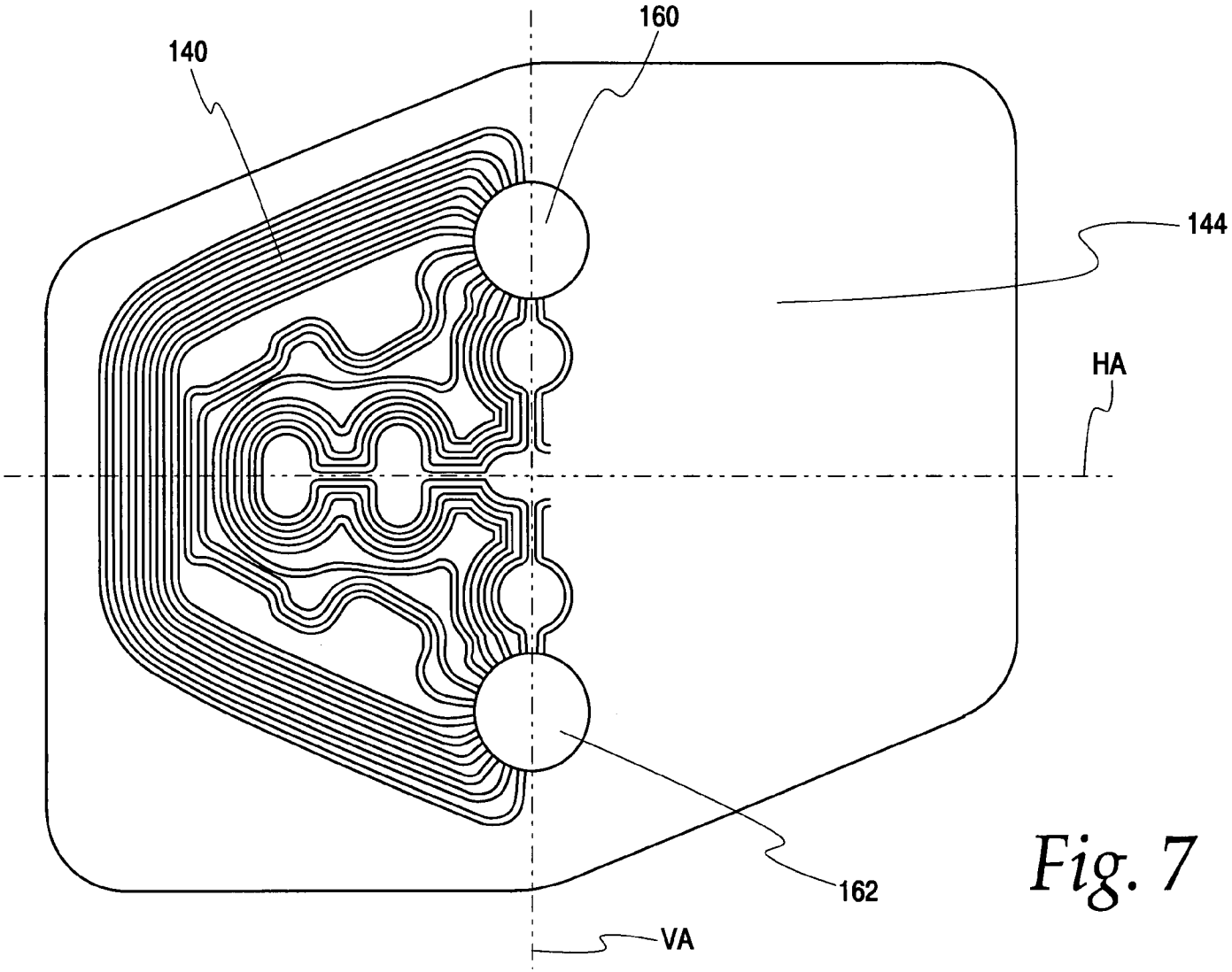
FIGS. 7-8 are plan views of embossed heat exchanger plates according to the third embodiment of the present invention.
Figure 8:
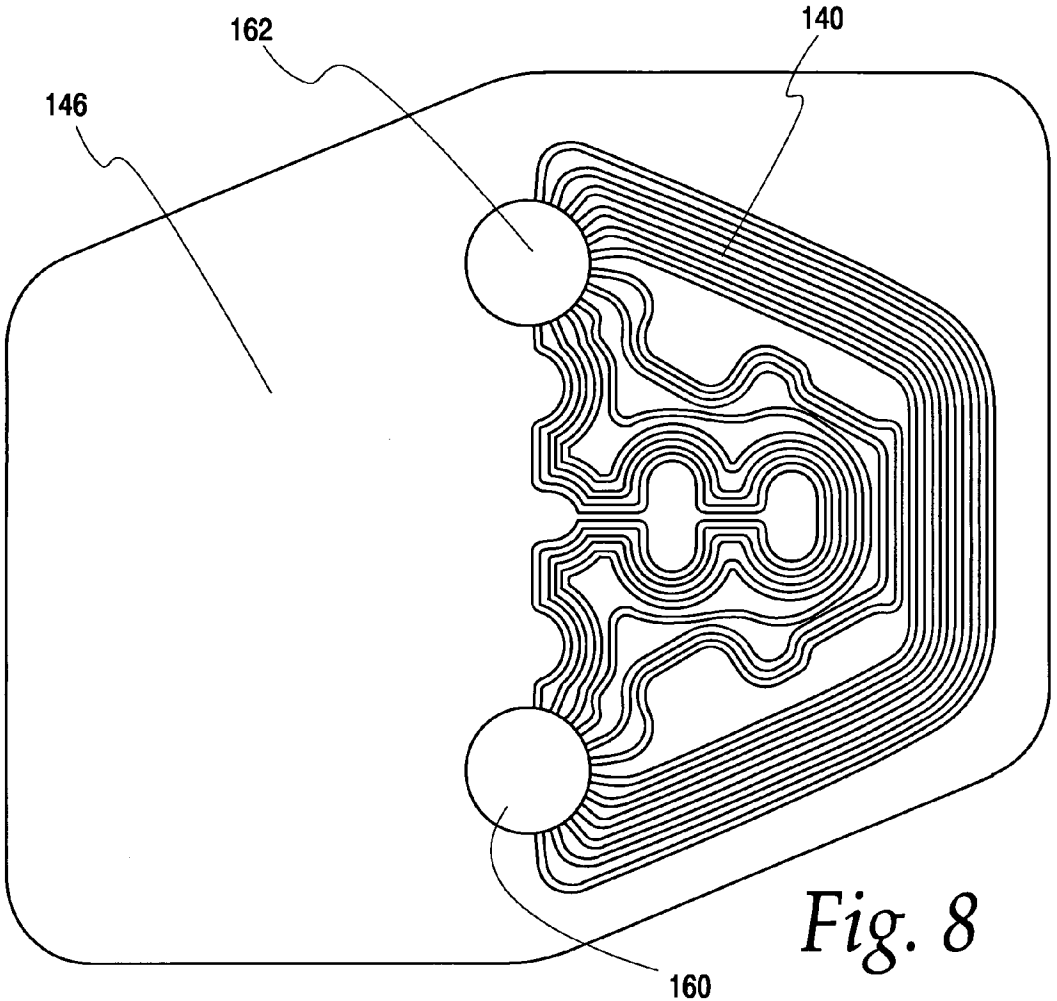

FIGS. 7 and 8 illustrate two surface sides of the heat exchanger plates 144 and 146 that may be metallically connected to form the flow channels 140 as illustrated in FIG. 6. One of the plates 144 or 146 is rotated for this purpose by 180° around axis HA so that the depicted surface sides come to lie against each other. In this illustrated embodiment, the flow channels 140 lying to the left or right of the vertical axis of symmetry VA are divided on the two heat exchanger plates 144, 146, which plates 144, 146 may have the same sheet thickness. FIGS. 7 and 8 illustrate the symmetry of the flow channels 140 and the associated distribution and collection channels 160, 162. The depicted external shape of the plates 144, 146 is not symmetrical FIGS. 7 and 8, but may advantageously be formed symmetrically.

Figure 9:
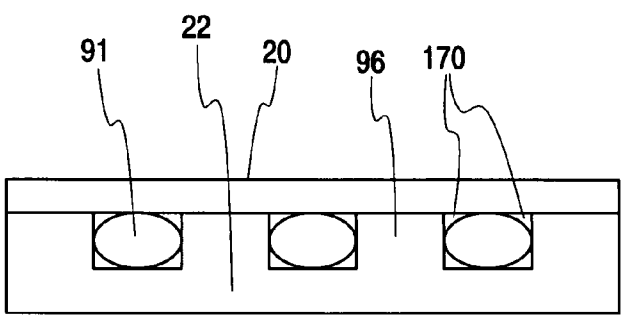
FIG. 9 is a cross-sectional view illustrating flow channels according to the present invention after soldering together of the two heat exchanger plates.

FIG. 9 illustrates the shape of the groove-like furrows 91 that form the flow channels 62 in the FIGS. 1-2 embodiment (with heat exchanger plates 20, 22 of different thicknesses) as changed after a soldering process to metallically connect the plates 20, 22. For example, the groove-like furrows 91 may be advantageously produced by embossing with roughly 0.8 mm width and about 1.0 mm depth. During the soldering process, the solder 170 flows into the groove-like furrow 91 so that a roughly elliptical or circular cross-section is formed in each groove-like furrow 91. This ideal cross-sectional shape ensures the lowest possible pressure loss along each flow channel 62. For oil coolers, the depth and width of the groove-like furrows 20 can be adjusted to the required conditions.

It will be appreciated that the cross-sectional size and hydraulic diameter of the flow channels can be varied depending upon the application. For example, advantageous hydraulic diameters of the flow channels for the refrigerant may lie between about 0.5 and 1.0 mm, but the hydraulic diameter of the flow channel may advantageously be above this value with water/oil heat exchangers.

It should thus be appreciated that plate heat exchanger according to the present invention may be produced cost effectively for advantageous use with media under high pressure (e.g., for heat exchange between the refrigerant in air conditioners and a liquid). For example, it should be appreciated that embossings formed in accordance with the present invention may be cost-effectively machined in one pass. Further, it should be appreciated that the present invention may allow the plate thickness of the two types of heat exchanger plates to be significantly different from each other (e.g., the unembossed heat exchanger plates may advantageously be significantly thinner than the embossed heat exchanger plates, leading to a material and weight saving notwithstanding the necessity to maintain media under high pressure. Moreover, embossing of the flow channels permits designs which achieve desired heat exchange effects which could not be achieved in the extrusion method known in the prior art.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A plate heat exchanger for exchanging heat between a first media and a second media, comprising:

a plurality of first heat exchanger plates alternately stacked with a plurality of second heat exchanger plates between a base plate and a cover plate, said first and second heat exchanger plates having at least four passages therethrough which align to define a first collecting channel and a first distribution channel for the first media and a second collecting channel and a second distribution channel for the second media;

first flow channels for the first media, each of said first flow channels being defined between one side of at least one of said first heat exchanger plates and a facing one side of the second heat exchanger plate adjacent said first plate one side, wherein said one side of said at least one first heat exchanger plate is substantially spaced apart from said facing one side of said second heat exchanger plate to form said first flow channels; and second flow channels for the second media, each of said second flow channels being defined between the other side of said at least one first heat exchanger plate and the other side of the second heat exchanger plate adjacent said at least one first plate other side, said second flow channels being defined by a plurality of discrete recesses defined within a thickness of at least one of the first and second heat exchanger plates, and said other sides being substantially metallically connected along their surfaces;

wherein said first and second heat exchanger plates have a continuous bent edge at which adjacent heat exchanger plates are metallically connected to each other, the bent edges of said plurality of first heat exchanger plates are longer than the bent edge of said plurality of said second heat exchanger plates, and the bent edges of the second heat exchanger plates separate the second heat exchanger plates from adjacent first heat exchanger plates and thereby at least partially define the first flow channels.

2. The plate heat exchanger of claim 1, wherein said recesses are embossments in said at least one of said first and second heat exchanger plates.

3. The plate heat exchanger of claim 1, wherein said second flow channels provide a hydraulic connection between said second collecting channel and said second distribution channel, said recesses being defined in a significant portion of said at least one of said first and second heat exchanger plates, whereby said passages defining said second collecting and distribution channels extend through said significant portion.

4. The plate heat exchanger of claim 1, wherein said recesses are groove-like furrows arranged in a mirror symmetry about an axis of said heat exchanger plates whereby second flow channels of generally equal length are present on opposite sides of said axis.

5. The plate heat exchanger of claim 1, wherein said recesses are defined in said second heat exchanger plates, and said second heat exchanger plates have a significantly greater plate thickness than said first heat exchanger plates.

6. The device of claim 1, wherein said recesses are defined in a significant portion of said at least one of said first and second heat exchanger plates, and said passages defining said first collecting and distribution channels extend through said first and second heat exchanger plates outside of said significant portion.

7. The device of claim 6, wherein said first heat exchanger plates are metallically joined to said second heat exchanger plates at adjacent surfaces outside of the significant portion.

8. A plate heat exchanger for exchanging heat between a first media and a second media, comprising:

a plurality of first heat exchanger plates alternately stacked with a plurality of second heat exchanger plates between a base plate and a cover plate, said first and second heat exchanger plates having at least four passages therethrough which align to define a first collecting channel and a first distribution channel for the first media and a second collecting channel and a second distribution channel for the second media;

first flow channels for the first media, each of said first flow channels being defined between one side of at least one of said first heat exchanger plates and a facing one side of the second heat exchanger plate adjacent said first plate one side, wherein said one side of said at least one first heat exchanger plate is substantially spaced apart from said facing one side of said second heat exchanger plate to form said first flow channels; and second flow channels for the second media, each of said second flow channels being defined between the other side of said at least one first heat exchanger plate and the other side of the second heat exchanger plate adjacent said at least one first plate other side, said second flow channels being defined by a plurality of discrete recesses defined within a thickness of the other side of at least one of the first and second heat exchanger plates, and said other sides being metallically connected along their surfaces;

wherein said recesses are defined in a significant portion of said second heat exchanger plates, said recesses including a plurality of substantially parallel groove-like furrows surrounding an enclosed portion of said significant portion, and said recesses further including additional groove-like furrows in said enclosed portion defining regions between selected groove-like furrows with a flat surface on said other side of said second heat exchanger plates;

wherein said first and second heat exchanger plates have a continuous bent edge at which adjacent heat exchanger plates are metallically connected to each other, and the bent edges of the second heat exchanger plates separate the second heat exchanger plates from adjacent first heat exchanger plates and thereby at least partially define the first flow channels.

9. The plate heat exchanger of claim 8, wherein said additional groove-like furrows wind around within said enclosed portion, and not all of said additional groove-like furrows in said enclosed portion are generally parallel to each other.

10. The plate heat exchanger of claim 1, wherein said first heat exchanger plates include a flat surface and said second heat exchanger plates include flat surfaces between said recesses, and adjacent flat surfaces of said first heat exchanger plates and second heat exchanger plates are metallically joined together.

11. A plate heat exchanger for exchanging heat between a first media and a second media, comprising:

a plurality of first heat exchanger plates alternately stacked with a plurality of second heat exchanger plates between a base plate and a cover plate, said first and second heat exchanger plates having at least four passages therethrough which align to define a first collecting channel and a first distribution channel for the first media and a second collecting channel and a second distribution channel for the second media;

first flow channels for the first media, each of said first flow channels being defined between one side of at least one of said first heat exchanger plates and a facing one side of the second heat exchanger plate adjacent said first plate one side, wherein said one side of said at least one first heat exchanger plate is substantially spaced apart from said facing one side of said second heat exchanger plate to form said first flow channels; and second flow channels for the second media, each of said second flow channels being defined between the other side of said at least one first heat exchanger plate and the other side of the second heat exchanger plate adjacent said at least one first plate other side, said second flow channels being defined by recesses defined within a thickness of the other side of at least one of the first and second heat exchanger plates, and said other sides being metallically connected along their surfaces;

wherein said first heat exchanger plates include a flat surface and said second heat exchanger plates include a flat surface between said recesses, and adjacent flat surfaces of said first heat exchanger plates and second heat exchanger plates are metallically joined together;

said recesses are defined in a significant portion of said second heat exchanger plates, said recesses including a plurality of substantially parallel groove-like furrows surrounding an enclosed portion of said significant portion, and additional groove-like furrows in said enclosed portion defining regions between selected groove-like furrows with a flat surface on said other side of said second heat exchanger plates; and said first and second heat exchanger plates are metallically joined at adjacent flat surfaces defined outside of said significant portion, at adjacent flat surfaces in the defined regions, and between said furrows, whereby said second flow channels defined by the furrows are discrete; and wherein said first and second heat exchanger plates have a continuous bent edge at which adjacent heat exchanger plates are metallically connected to each other, and the bent edges of the second heat exchanger plates separate the second heat exchanger plates from adjacent first heat exchanger plates and thereby at least partially define the first flow channels.

12. The plate heat exchanger of claim 11, further comprising turbulence inserts in the first flow channels between said spaced one sides of said first and second heat exchanger plates.

13. The plate heat exchanger of claim 11, wherein said first media is engine coolant and said second media is $CO_2$ refrigerant of a vehicle air conditioner.

14. The plate heat exchanger of claim 13, further comprising a rod-like element in said second collecting and distribution channels adapted to increase the pressure stability of the plate heat exchanger.

15. The plate heat exchanger of claim 1, wherein one of said media is oil and the other of said media is water.

16. The plate heat exchanger of claim 1, wherein the recesses are groove-like furrows in the second heat exchanger plates, and second flow channels being defined by said groove-like furrows and the facing flat surface of said first heat exchanger plates aligned over said furrows.

* * * * *